US008535118B2

(12) United States Patent
Cobb et al.

(10) Patent No.: US 8,535,118 B2
(45) Date of Patent: Sep. 17, 2013

(54) MULTI-SPINDLE CHEMICAL MECHANICAL PLANARIZATION TOOL

(75) Inventors: Michael A. Cobb, Croton on Hudson, NY (US); Mahadevaiyer Krishnan, Hopewell Junction, NY (US); Michael F. Lofaro, Hopewell Junction, NY (US); Dennis G. Manzer, Bedford Hills, NY (US)

(73) Assignee: International Business Machines Corporation, Armonk, NY (US)

( * ) Notice: Subject to any disclaimer, the term of this patent is extended or adjusted under 35 U.S.C. 154(b) by 33 days.

(21) Appl. No.: 13/237,374

(22) Filed: Sep. 20, 2011

(65) Prior Publication Data

US 2013/0072089 A1 Mar. 21, 2013

(51) Int. Cl.
*B24B 1/00* (2006.01)

(52) U.S. Cl.
USPC ..... 451/41; 451/194; 451/195; 451/209; 451/212

(58) Field of Classification Search
USPC ..... 451/41, 194, 195, 209, 212, 242, 451/132, 488, 461, 199
See application file for complete search history.

(56) References Cited

U.S. PATENT DOCUMENTS 3,583,110 A * 6/1971 Scott ..... 451/41
3,862,517 A * 1/1975 Porter, Jr. ..... 451/28
4,864,776 A 9/1989 Morrison
5,700,179 A * 12/1997 Hasegawa et al. ..... 451/41
5,707,274 A * 1/1998 Kim et al. ..... 451/285
5,735,731 A * 4/1998 Lee ..... 451/143
5,944,588 A 8/1999 Marmillion et al.
5,961,381 A 10/1999 Alexeev et al.
5,967,881 A * 10/1999 Tucker ..... 451/41
6,152,809 A * 11/2000 Yenawine ..... 451/69
6,419,443 B2 * 7/2002 Takenoshita et al. ..... 415/11
6,517,420 B2 * 2/2003 Ishikawa et al. ..... 451/67
6,547,652 B1 * 4/2003 Roy ..... 451/285
6,616,516 B1 * 9/2003 Ravkin et al. ..... 451/194
6,620,029 B2 * 9/2003 Khoury et al. ..... 451/6
2006/0030246 A1 * 2/2006 Bauer et al. ..... 451/41
2006/0252350 A1 * 11/2006 Farrar ..... 451/5

OTHER PUBLICATIONS

Office Action, dated May 16, 2013, received in a related U.S. Patent Application, namely U.S. Appl. No. 13/605,363.

* cited by examiner

*Primary Examiner* — George Nguyen
(74) *Attorney, Agent, or Firm* — Scully, Scott, Murphy & Presser, P.C.; Louis J. Percello, Esq.

(57) ABSTRACT

An apparatus for chemical mechanical planarization includes a spindle assembly structure and at least one substrate carrier, which make a linear lateral movement relative to each other while abrasive surfaces of a plurality of cylindrical spindles in the spindle assembly structure contact, and rotate against, at least one substrate mounted on the at least one substrate carrier. The direction of the linear lateral movement is within the plane that tangentially contacts the plurality of cylindrical spindles, and can be orthogonal to the axes of rotation of the plurality of cylindrical spindles.

19 Claims, 12 Drawing Sheets

40
T
R
R
d
30
p
p
33
36
34
24
32
z
y 40
30
74B
74A
74A
74A
74C
74A
74A
74B
33
32
24
22
x
y

MULTI-SPINDLE CHEMICAL MECHANICAL PLANARIZATION TOOL

BACKGROUND

The present disclosure generally relates to apparatuses for chemical mechanical planarization and methods for operating the same.

As semiconductor technologies and methods have advanced over time, chemical mechanical planarization (CMP) processes and tooling have been modified for the purpose of controlling many required aspects of the CMP processes and the end result thereof. A few exemplary aspects interrelated through the CMP processing include, but are not limited to, within-wafer non-uniformity, ultralow dielectric constant films and the associated sensitivities to process forces and induced stresses, extremely fine pattern dimensions and the associated sensitivities to defects and material loss from within patterned features, and increasing sizes of the substrates, e.g., from 125 mm, to 200 mm, to 300 mm, and then to a proposed 450 mm in the diameter of a substrate.

There have been many attempts at novel CMP apparatus and methods towards addressing such aspects of the CMP. With respect to novel CMP Polish Platforms, while these all had their own individual strengths or focuses, they also lacked overcoming one or more of the fundamental issues associated with the historical and currently used rotational platform and, thus, failed in the end. With regard to the rotational CMP platform widely recognized and used in the industry as the CMP standard, the CMP module has evolved into a system that makes use of very complex mechanical apparatus and process control schemes in an attempt to combat these fundamental issues.

One such example is the industry wide acceptance of the pressurized wafer carrier. This wafer carrier is divided into several 'zones' each with its own 'air bladder' for the purpose of controlling within-wafer non-uniformity by applying varying forces radially across the backside of the wafer during the polish cycle. For the bladder pressures required to adequately compensate for within-wafer non-uniformity, it was found the wafer would slip out during the course of the polish cycle. The 'retaining ring' forms the 'pocket' that retains or holds the wafer in place during the course of polishing. Historically, the retaining ring did not contact the surface of the polishing pad, but rather was mounted to the carrier with a fixed depth to the pocket that allowed ~0.008"-0.012" of wafer protrusion. With the potential for wafer slip, this bladder carrier also required a design change to incorporate a pressurized retaining ring such that said retaining ring is in contact with the polishing pad surface to better hold the wafer during the polish cycle.

Another aspect of within-wafer non-uniformity is a very local region referred to as the 'edge bead' or 1-5 mm region at the perimeter of the wafer. Typically, the polish removal at this region is significantly different than the remainder or 'body' of the wafer due to the compression of the pad material as it meets the bevel of the wafer during rotation on the leading edge of the wafer carrier and the subsequent relaxation of the pad material at it is drawn across the surface wafer. Historically, only the wafer and pad contact created this edge bead issue. With the advent of the pressurized retaining ring, there are now two regions of contact that require controlling to reduce the edge bead impact—the retaining ring itself, as well as the bevel of the wafer now tucked inside the width of this retaining ring. The pressurized retaining ring can be a benefit to reducing the historical edge bead effect. However, it has been found—as the pressure applied to the retaining ring is coupled to the pressures applied to the zones of the bladder carrier—this additional mechanical component can also amplify the problem at the edge region of the wafer. In addition, fluid dynamics have always been a complicated component of the rotational platform. Adequate fresh slurry distribution across the entire wafer and removal of spent effluent in an efficient manner are both known to contribute to within-wafer non-uniformity and defectivity levels. The introduction of a retaining ring that rides in contact with the surface of pad has served to further inhibit the flow of fluids.

While the design and capabilities of the bladder carrier as known in the art provides some benefits, one must also accept the accompanying added complexity to the design, the maintenance, and ultimately the CMP process itself caused by use of the bladder carrier.

SUMMARY

An apparatus for chemical mechanical planarization includes a spindle assembly structure and at least one substrate carrier, which make a linear lateral movement relative to each other while abrasive surfaces of a plurality of cylindrical spindles in the spindle assembly structure contact, and rotate against, at least one substrate mounted on the at least one substrate carrier. The direction of the linear lateral movement is within the plane that tangentially contacts the plurality of cylindrical spindles, and can be orthogonal to the axes of rotation of the plurality of cylindrical spindles.

According to an aspect of the present disclosure, an apparatus for chemical mechanical planarization is provided, which includes a spindle assembly structure and at least one substrate carrier. The spindle assembly structure includes a plurality of cylindrical spindles. Each of the cylindrical spindles is configured to rotate around its axis of cylindrical symmetry. A two-dimensional plane tangentially contacts cylindrical surfaces of the plurality of cylindrical spindles. The at least one substrate carrier is configured to hold at least one substrate, and is mounted on a carrier platform. The spindle assembly structure and the carrier platform are configured to move relative to each other along a direction that is parallel to the two-dimensional plane.

According to another aspect of the present disclosure, a method of operating an apparatus for chemical mechanical planarization is provided. The method includes providing an apparatus including a spindle assembly structure, at least one substrate carrier, and a carrier platform; mounting at least one substrate on the at least one substrate carrier; and planarizing at least one surface of the at least one substrate. The apparatus includes a plurality of cylindrical spindles. Each of the cylindrical spindles is configured to rotate around its axis of cylindrical symmetry. A two-dimensional plane tangentially contacts cylindrical surfaces of the plurality of cylindrical spindles. The at least one substrate carrier is mounted on the carrier platform. The planarization of the at least one surface of the at least one substrate is effected by moving the spindle assembly structure and the carrier platform relative to each other along a direction that is parallel to the two-dimensional plane while the at least one surface is in contact with the plurality of cylindrical spindles and the plurality of cylindrical spindles rotates around their axes of cylindrical symmetry.

BRIEF DESCRIPTION OF THE SEVERAL VIEWS OF THE DRAWINGS

In the various drawings, x, y, and z directions refer to three orthogonal directions in a Cartesian coordinate system that has been selected for the purpose of illustration of the various structures of the present disclosure.

DETAILED DESCRIPTION

As stated above, the present disclosure relates to apparatuses for chemical mechanical planarization and methods for operating the same, which are now described in detail.

Figure 1A:
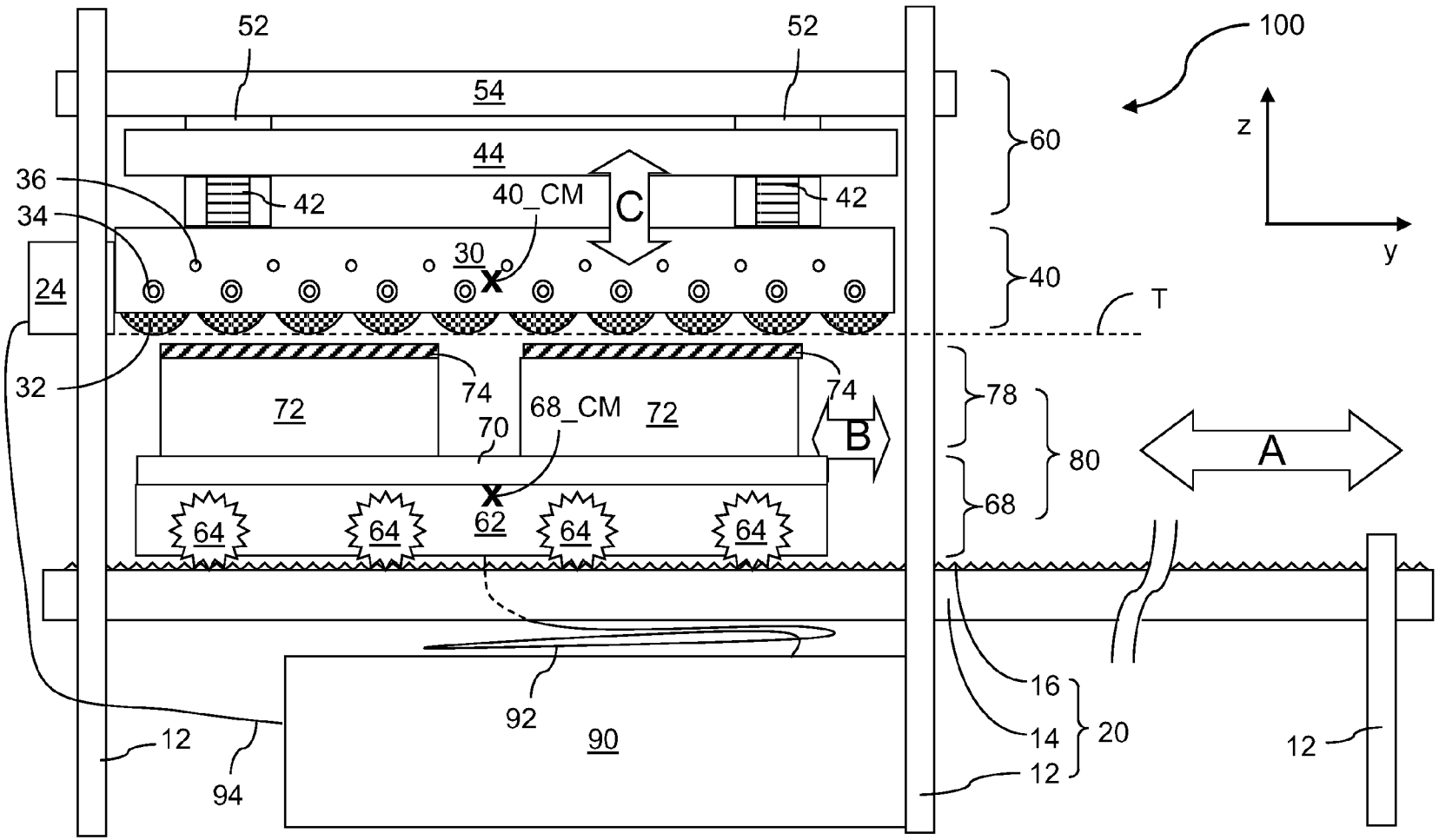
FIG. 1A is a side view of a first exemplary apparatus for chemical mechanical planarization according to a first embodiment of the present disclosure.
Figure 1B:
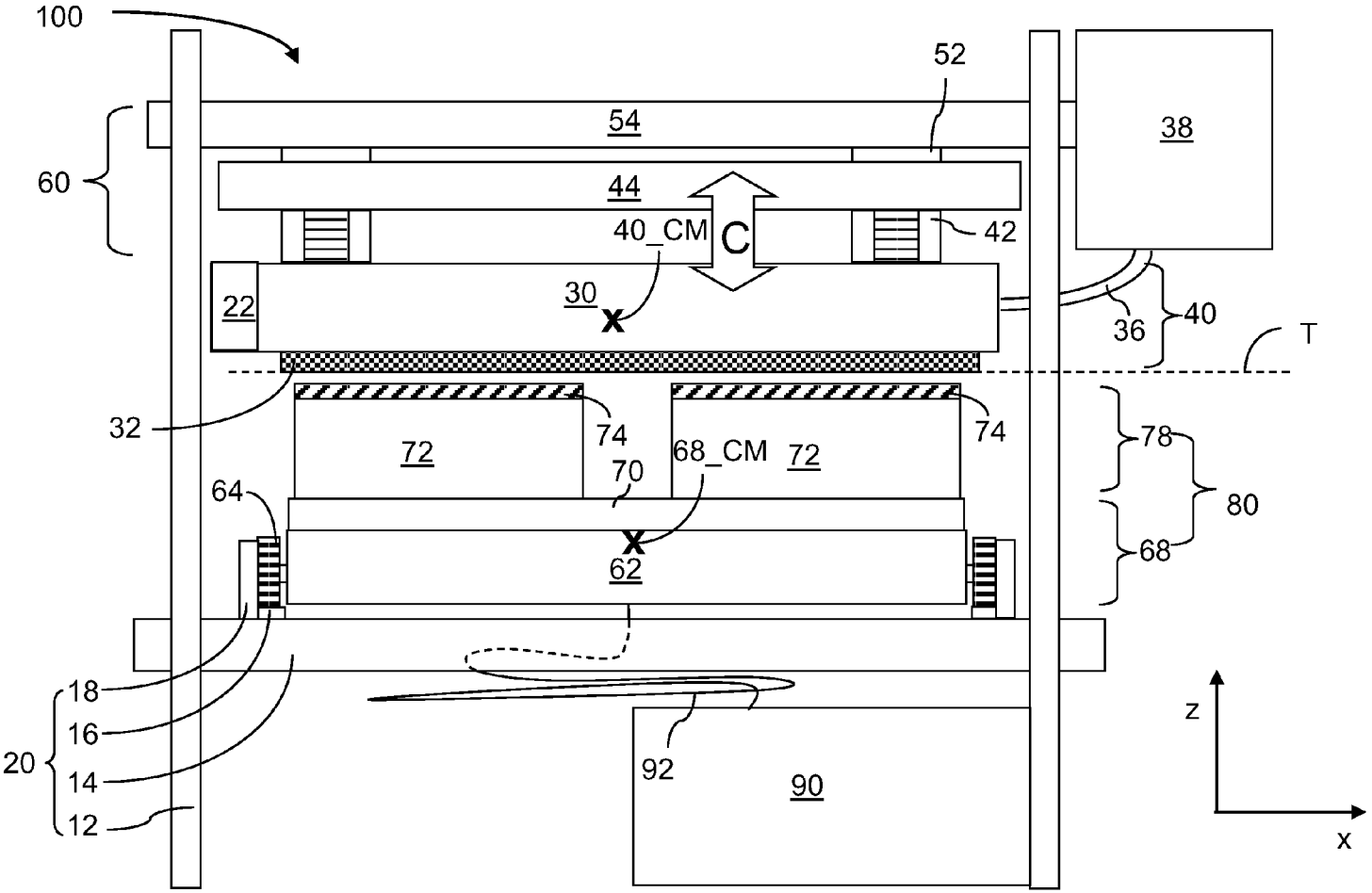
FIG. 1B is a front view of the first exemplary apparatus for chemical mechanical planarization according to the first embodiment of the present disclosure.

Referring to FIGS. 1A and 1B, a first exemplary apparatus 100 for chemical mechanical planarization according to a first embodiment of the present disclosure includes a frame assembly 20, an upper support structure assembly 60 affixed to an upper portion of the frame assembly 20, a spindle assembly structure 40 adjustably attached to the upper support structure assembly 60, and a carrier assembly 80 that slides into, and out of, a region underneath the spindle assembly structure 40 along direction A (represented by a bidirectional arrow labeled "A"), which is the y direction of a Cartesian coordinate system. As used herein, a "direction" includes a set of two directions that are opposites of each other, e.g., a pair of forward and backward directions, a pair of up and down directions, a pair of left and right directions, etc. A control and power supply system 90 provides power to various mechanical drive mechanisms and control signals via cables (92, 94).

The frame assembly 20 can include vertical support structures 12 having a lengthwise direction along a vertical direction, i.e., the z direction, and at least one horizontal track having a lengthwise direction along a horizontal direction, i.e., the y direction. The frame assembly 20 is stationary relative to the structure to which the first exemplary apparatus 100 is affixed (e.g., the floor of a building that houses the first exemplary apparatus 100). Each of the at least one horizontal track can include a horizontal beam 14 and a transport guidance structure 16, which can be, for example, a rack (as illustrated) or any other alternative stepping mechanism that can induce lateral transportation of the carrier assembly 80. The frame assembly 20 can optionally include lateral guidance rails 18 that are configured to laterally confine the carrier assembly 80.

The upper support structure assembly 60 provides a platform relative to which the spindle assembly structure 40 can move at least along direction C (represented by a bidirectional arrow labeled "C"). In one embodiment, the upper support structure assembly 60 can include horizontal plates (54, 44) and fixed vertical connection structures 52 that are stationary relative to the frame assembly 20.

The spindle assembly structure 40 can be attached to a lower portion of the upper support structure assembly 40, by at least one component that provides a variable length, which can be, for example, at least one stepper 42 including an embedded driver motor (not shown), a male (or female) screw thread attached to the embedded driver motor, and a female (or male) screw thread engaged to the male (or female) screw thread, configured not to rotate with the male (or female thread), and slidably adjoined to a vertical guiding rail (not shown). The resolution of the vertical movement of the spindle assembly structure 40 relative to the upper support structure assembly can be at a sub-micron level. Multiple steppers 42 can be employed to enable tilting of the spindle assembly structure 40 from a vertical direction, i.e., the z direction, to match any potential tilting of surfaces of substrate 74 to be polished.

The spindle assembly structure 40 includes a plurality of cylindrical spindles 32. Each of the plurality of cylindrical spindles 32 has an abrasive cylindrical surface, which can be provided by attaching a cylindrical abrasive pad to a cylindrical core. Each of the cylindrical spindles 32 is configured to rotate around its axis of cylindrical symmetry, which is along the x direction. A two-dimensional horizontal plane T tangentially contacts cylindrical surfaces of the plurality of cylindrical spindles 32. The angular velocity of the rotation of the cylindrical spindles 32 can be in a range from 60 revolutions per minute (RPM) to 6,000 RPM, although lesser and greater RPM's can also be employed.

In one embodiment, the two-dimensional plane T can be a horizontal two-dimensional plane, i.e., an x-y plane.

The carrier assembly 80 can include a stack of a carrier platform 68, at least one substrate carrier 72 mounted upon the carrier platform 68, and at least one substrate 74 mounted on each of the carrier platform 68. Each of the at least one substrate 74 is a workpiece to be planarized by a chemical mechanical planarization process to be performed in the first exemplary apparatus 100. The spindle assembly structure 40 can overlie the carrier platform 68.

Each of the at least one substrate carrier 72 is configured to hold a substrate 74, which can be a semiconductor substrate known in the art. Each of the at least one substrate carrier 72 is mounted on the carrier platform 68. At least one stack of a substrate carrier 72 and a substrate 74 mounted upon the substrate carrier 72 is collectively referred to as at least one mounted substrate carrier 78. Each of the at least one substrate carrier 72 can include an outer frame having a cylindrical symmetry and an upper surface having a shape of a circle.

The carrier platform 68 can include a stack of an upper carrier platform 70 and a lower carrier platform 62 that are structurally stationary relative to each other. The upper carrier platform 70 can include devices for rotating each of the at least one substrate carrier 72. The upper carrier platform 70 may further include a vacuum manifold and a vacuum pump for holding the at least one substrate 74 on the at least one substrate carrier 72.

A set of transport actuation structures 64 are attached to the lower carrier platform 62. In one embodiment, the set of transport actuation structures 64 can be a set of pinions 64 configured to spin around their rotational axes so that the carrier assembly 80 moves in the y direction. Any alternate mechanical components can be employed in lieu of a combination of the pinions 64 and the rack 16 provided that such a combination enables the movement of the carrier assembly 80 along the y direction.

The spindle assembly structure 40 and the carrier assembly 80 are configured to move relative to each other along the y direction, which is a direction that is parallel to the two-dimensional plane T and the rotational axes of the plurality of cylindrical spindles 32 that are along the x direction. The direction of the relative movement between the spindle assembly structure 40 and the carrier assembly 80 is schematically represented by a bidirectional arrow B.

For operation of the first exemplary apparatus 100, the carrier assembly 80 in a state without a mounted substrate is retracted from the position under the spindle assembly structure 40 along the transport guidance structure 16 in the y direction. At least one substrate 74 is mounted on the at least one substrate carrier 74, for example, by a robot. The carrier assembly 80, which is now in a state having at least one mounted substrate 74, is inserted into the position under the spindle assembly structure 40 along the transport guidance structure 16 in the y direction.

Subsequently, the spindle assembly structure 40 and the carrier platform 68 are moved relative to each other in a direction perpendicular to the two-dimensional plane T until at least one surface of the at least one substrate 74 contacts the plurality of cylindrical spindles 32. In one embodiment, the rotation of the plurality of cylindrical spindles 32 may commence after a contact is made between the at least one surface of the at least one substrate 74 and the plurality of cylindrical spindles 32. In another embodiment, the rotation of the plurality of cylindrical spindles 32 may commence before a contact is made between the at least one surface of the at least one substrate 74 and the plurality of cylindrical spindles 32.

In order to planarize the at least one substrate 74, the top surface(s) of the at least one substrate 74 and the two-dimensional plane T can be brought to contact with each other by an upward vertical movement of the carrier assembly 80 relative to the frame assembly 20, by a downward vertical movement of the spindle assembly structure 40 relative to the frame assembly 20 and stationary horizontal plates (54, 44) by actuation of the at least one stepper 42, or a combination thereof.

As discussed above, any at least one component that provides a variable length can be used in lieu of the at least one stepper 42 to level the two-dimensional plane T and/or adjust the two-dimensional plane T to match the plane of the physical top surfaces of the at least one substrate 74. Thus, the first exemplary apparatus 100 is configured to move the spindle assembly structure 40 and the carrier platform 68 relative to each other, when, and after, the at least one substrate 74 is mounted on the at least one substrate carrier 72, until a contact is made between at least one top surface of the at least one substrate 74 and portions of the cylindrical surfaces of the plurality of cylindrical spindles 32 on the two-dimensional plane T.

Further, the spindle assembly structure 40 and the carrier platform 68, which is a part of the carrier assembly 80, are configured to move relative to each other along any selected direction within the plane of the two-dimensional plane, provided that the selected direction is different from the direction of the axes of the plurality of cylindrical spindles 32 (i.e., the x direction), while the at least one substrate 74 remains in contact with the portions of the cylindrical surfaces of the plurality of cylindrical spindles 32 that tangentially touch the two-dimensional plane T. Thus, the spindle assembly structure 40 and the carrier platform 68 are moved relative to each other along a direction that is parallel to the two-dimensional plane T, i.e., any direction in the x-y plane other than the x direction, while at least one surface of the at least one substrate 74 is in contact with the plurality of cylindrical spindles 32 and while the plurality of cylindrical spindles 32 rotates around their axes of cylindrical symmetry.

In one embodiment, the spindle assembly structure 40 and the carrier platform 68 are configured to move relative to each other along the y direction while the at least one substrate 74 remains in contact with the portions of the cylindrical surfaces of the plurality of cylindrical spindles 40 that tangentially touch the two-dimensional plane T.

In one embodiment, the center of mass 40_CM of the spindle assembly structure 40 remains stationary, and a center of mass 68_CM of the carrier platform 68 moves along the y direction.

In one embodiment, the spindle assembly structure 40 and the carrier platform 68 are configured to move relative to each other in a back-and-forth motion along the y direction, i.e., along the direction indicated by the bidirectional arrow B. The frequency of the back-and-forth motion can be, for example, from 0.01 Hz to 3 Hz, although lesser and greater frequencies can also be employed.

In one embodiment, each of the at least one substrate carrier 72 can be configured to be stationary relative to the carrier platform 68. In other words, the at least one substrate carrier 72 does not rotate around any axis, and all points within the at least one substrate carrier 72 moves at the same velocity as the carrier platform 68. Thus, rotation of the at least one substrate 74 can be eliminated, which is mounted to, and is stationary relative to, the at least one substrate carrier 72. This configuration can serve to enhance the benefits of the uniform removal rate provided by the plurality of cylindrical spindles 32 in rotation in some embodiments.

In another embodiment, each of the at least one substrate carrier 72 can be configured to rotate around an axis that is perpendicular to the two-dimensional plane T. The angular velocity of rotation of each of the at least one substrate carrier 72 can be less than the angular velocity of rotation of the cylindrical spindles 32. The angular velocity of the rotation of the at least one substrate carrier 72 and the at least one substrate 74 mounted thereupon can be in a range from 0.02 revolutions per minute (RPM) to 2 RPM, although lesser and greater RPM's can also be employed. In one embodiment, the angular velocity of rotation of each of the at least one substrate carrier 72 can be less than the angular velocity of rotation of the cylindrical spindles 32 by more than two orders of magnitude. In some cases, the relative low rate of rotation of the at least one substrate carrier 72 relative to the rate of rotation of the cylindrical spindles 32 can enhance the uniformity of planarized surfaces of the at least one substrate 72 in some embodiments.

A slurry tank 38 and a fluid distribution manifold 36 are provided for distribution of a slurry onto the at least one substrate 74 through the spindle assembly structure 40.

Figure 2A:
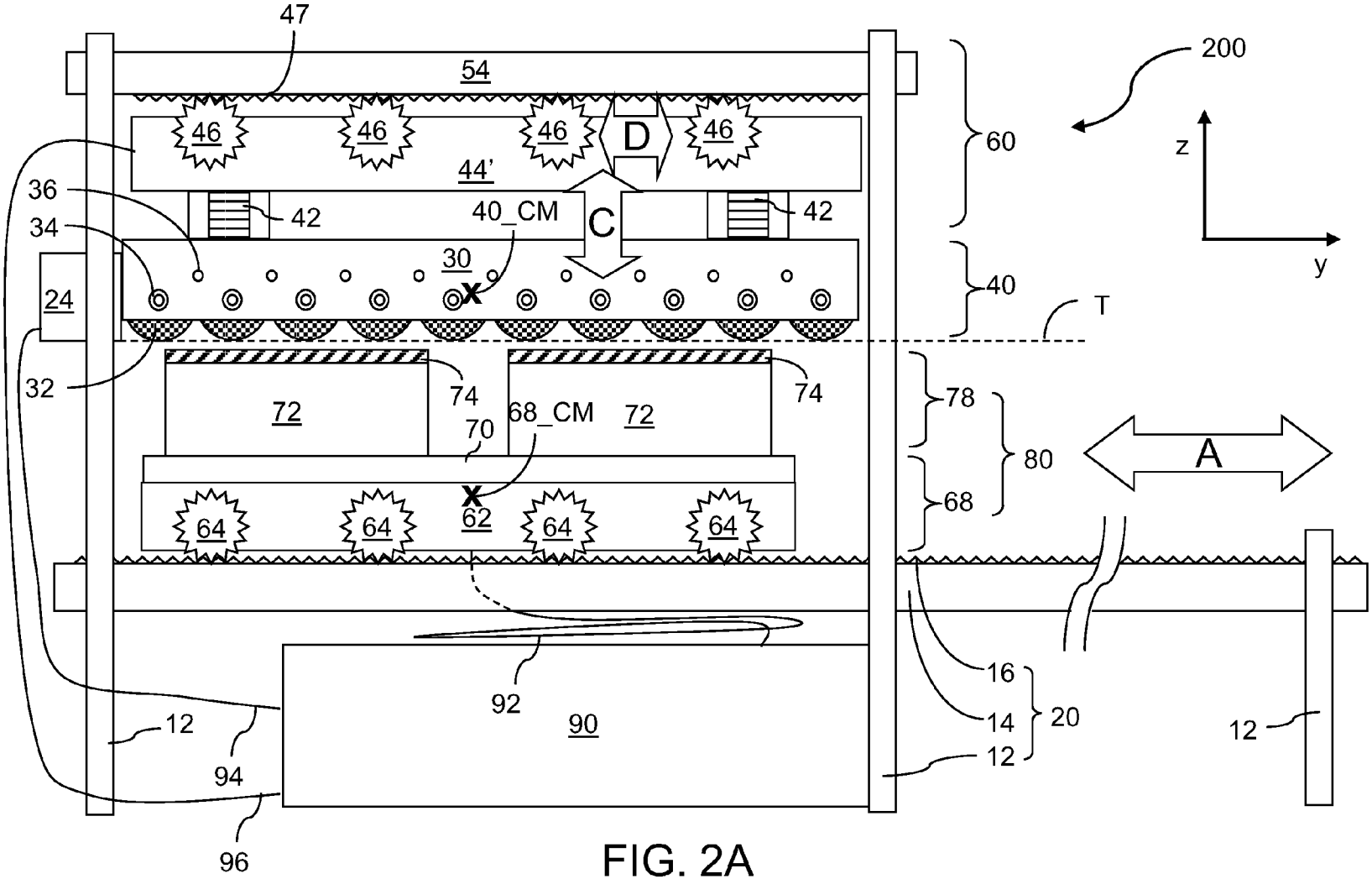
FIG. 2A is a side view of a second exemplary apparatus for chemical mechanical planarization according to a second embodiment of the present disclosure.
Figure 2B:
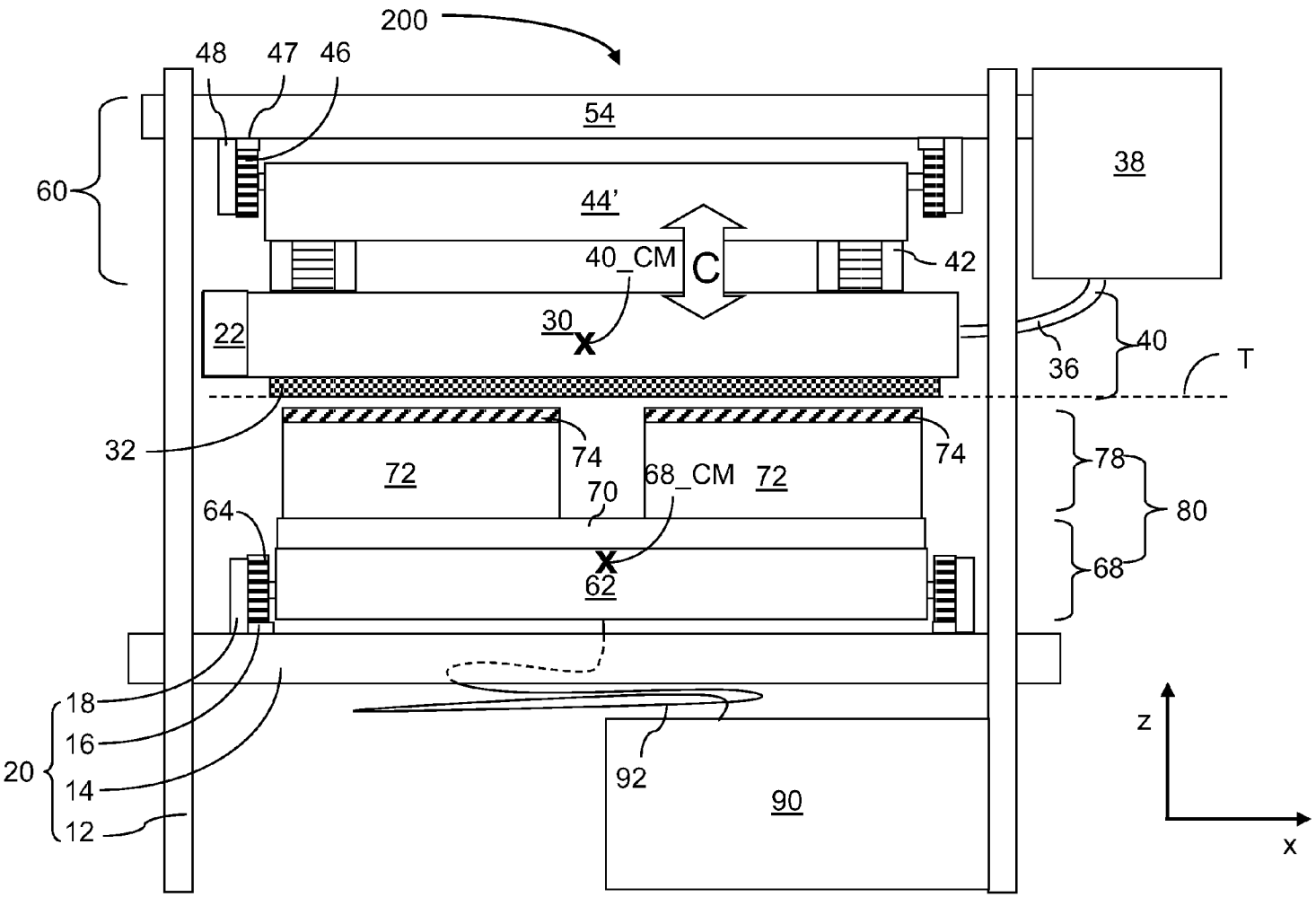
FIG. 2B is a front view of the second exemplary apparatus for chemical mechanical planarization according to the second embodiment of the present disclosure.

Referring to FIGS. 2A and 2B, a second exemplary apparatus 200 for chemical mechanical planarization according to a second embodiment of the present disclosure can be derived from the first exemplary apparatus 100 of FIG. 1 by configuring a lower horizontal plate 44 to be movable relative to an upper horizontal plate 54 in a horizontal direction that is different from the direction of the rotational axes of the plurality of cylindrical spindles 32, i.e., in any horizontal direction in the x-y plane other than the x direction. The direction of the movement of the lower horizontal plate 44 relative to an upper horizontal plate 54 is illustrated by a bidirectional arrow labeled "D." In one embodiment, the lower horizontal plate 44 can be configured to be movable relative to an upper horizontal plate 54 along the y direction, which is the same direction as the direction of the movement of the carrier platform 68.

As in the first exemplary apparatus 100, the second exemplary apparatus 200 is configured to move the spindle assembly structure 40 and the carrier platform relative to each other in a direction perpendicular to the two-dimensional plane T, i.e., in the direction of the bidirectional arrow C, in order to bring the surface(s) of the at least one substrate 74 and the bottommost portions of the cylindrical surfaces of the plurality of cylindrical spindles 32.

During the planarization process, a center of mass 68_CM of the carrier platform 68 remains stationary, and a center of mass 40_CM of the spindle assembly structure 40 moves along the direction of the bidirectional arrow D. The horizontal movement of the spindle assembly structure 40 relative to the stationary frame assembly 20 and the center of mass 68_CM of the carrier platform 68 can be a back-and-forth motion as in the operation of the first exemplary apparatus.

The relative horizontal movement between the center of mass 68_CM of the carrier platform 68 and the center of mass 40_CM of the spindle assembly structure 40 can be effected, for example, by replacing the fixed vertical connection structures 52 in the first exemplary apparatus 100 with at least another horizontal track having a lengthwise direction along a horizontal direction, i.e., any horizontal direction within the x-y plane other than the x-axis, which is parallel to the axes of rotation for the plurality of cylindrical spindles 32. For example, the lengthwise direction of the at least another horizontal track can be the y direction. The two stationary horizontal plates (44, 54) of the first exemplary apparatus 100 can be replaced by a combination of a stationary horizontal plate 54 that remains stationary relative to the frame assembly 20 and a movable horizontal plate 44' that can move along the lengthwise direction of the at least another track.

Each of the at least another horizontal track can include a transport guidance structure 47, which can be, for example, a rack (as illustrated) or any other alternative stepping mechanism that can induce lateral transportation of the spindle assembly structure 40. A set of transport actuation structures can be attached to the movable horizontal plate 44'. In one embodiment, the set of transport actuation structures can be a set of pinions 46 configured to spin around their rotational axes so that the movable horizontal plate 44' moves in the lengthwise direction of the at least another track. Any alternate mechanical components can be employed in lieu of a combination of the pinions 46 and the rack 47 provided that such a combination enables the movement of the movable horizontal plate 44' and the spindle assembly structure 40 that is suspended therefrom. Optionally, lateral guidance rails 48 can be provided, which are configured to laterally confine the movable horizontal plate 44' and the spindle assembly structure 40.

Figure 3A:
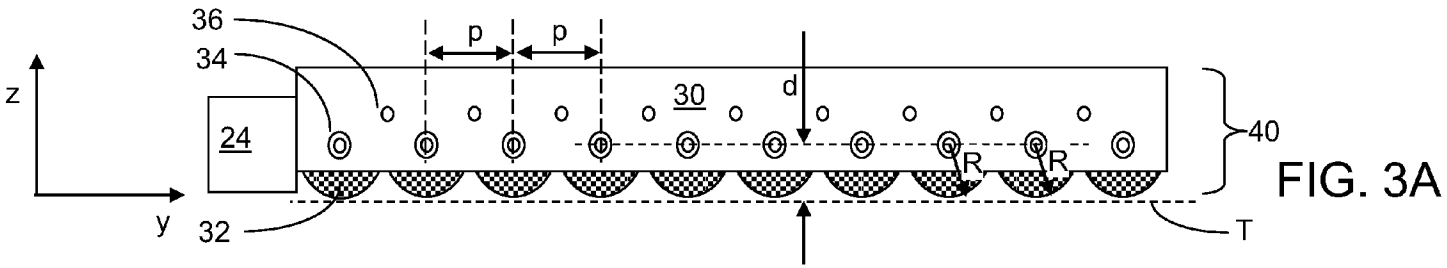
FIG. 3A is a side view of a first example for a spindle assembly structure according to an embodiment of the present disclosure.
Figure 3B:
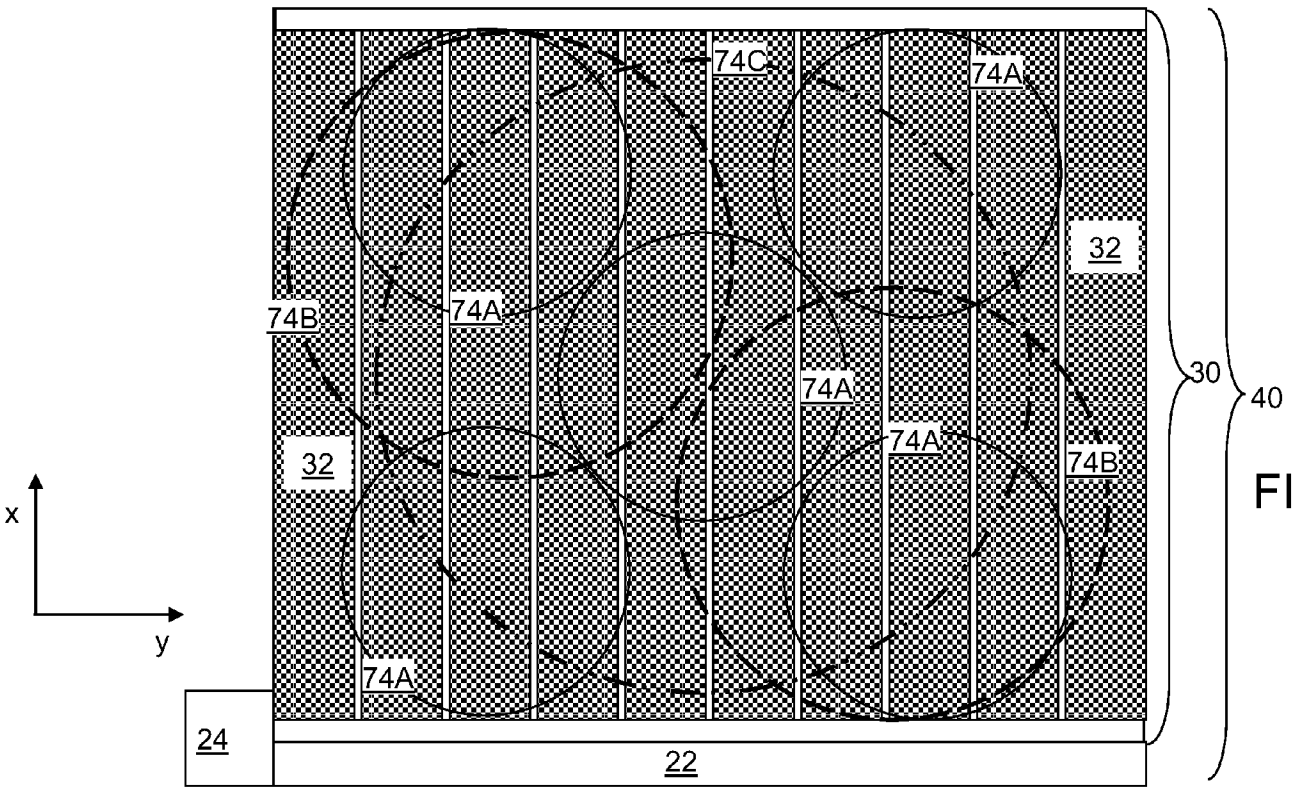
FIG. 3B is a bottom view of the first example for the spindle assembly structure of FIG. 3A according to an embodiment of the present disclosure.

Referring to FIGS. 3A and 3B, a first example for the spindle assembly structure 40 is illustrated in detail. The first example for the spindle assembly structure 40 can be employed in the first or second exemplary apparatus (100, 200) of FIGS. 1A, 1B, 2A, and 2B. The first example for the spindle assembly structure 40 includes a spindle frame 30, which structurally supports the axes 34 of rotation of the plurality of the cylindrical spindles 32 so that the center of mass of each cylindrical spindle 32 remains stationary with respect to the spindle frame 30. Further, the spindle frame 30 functions as a mechanical structure to which a gear assembly 22 and a gear driver motor 24 can be attached.

Multiple cylindrical spindles 32 in the plurality of cylindrical spindles 32 have axes 34 of cylindrical symmetry that are parallel to one another, which is the x direction in the illustration. In one embodiment, all cylindrical spindles 32 in the plurality of cylindrical spindles 32 can have axes 34 of cylindrical symmetry that are parallel to one another, which is the x direction in the illustration. Each of the cylindrical surfaces of the plurality of cylindrical spindles 32 can be an abrasive surface of a cylindrical abrasive pad. The abrasive surface can include any abrasive material known in the art.

In one embodiment, the axes 34 of cylindrical symmetry in the plurality of cylindrical spindles 32 are arranged in a one-dimensional array having a pitch p. In this case, each neighboring pair of the axes 34 of cylindrical symmetry are spaced from each other by a same spacing, which is equal to the pitch p. The direction of the one-dimensional array can be within the two-dimensional plane T. In one embodiment, the direction of the pitch p in the one-dimensional array can be orthogonal to the direction of the axes of the cylindrical symmetry in the plurality of cylindrical spindles 32. For example, the direction of the axes of the cylindrical symmetry in the plurality of cylindrical spindles 32 can be the x direction, and the direction of the pitch p in the one-dimensional array can be in the y direction.

In one embodiment, the multiple cylindrical spindles 32 in the plurality of cylindrical spindles 32 can have a same radius R.

The direction along which the axes 34 of cylindrical symmetry are oriented is herein referred to as a first direction. The first direction is parallel to the two-dimensional plane T as discussed above. The direction along which the spindle assembly structure 40 and the carrier platform 68 are configured to move relative to each other is herein referred to as a second direction, which is parallel to the two-dimensional plane T, and is different from the first direction. In one embodiment, the second direction can be orthogonal to the first direction.

The spindle assembly structure 40 can include a gear assembly 22 and a gear driver motor 24. The gear assembly 22 includes gears (not individually shown) that are engaged with one another and configured to rotate the plurality of cylindrical spindles 32. In one embodiment, the sizes of the gears can be selected to rotate the plurality of cylindrical spindles 32 at a same angular velocity. Neighboring pairs of cylindrical spindles 32 can rotate in opposite rotational directions, e.g., one rotates in a clockwise direction and the other rotates in a counterclockwise direction, or can rotate in the same rotational directions. The gear driver motor 24 is configured to initiate a rotary motion that is transmitted to the plurality of cylindrical spindles 32 through the gear assembly 22. The gear driver motor 24 and the gear assembly 22 can be replaced with any rotational drive device configured to synchronously rotate the plurality of cylindrical spindles 32.

In an illustrated example, peripheries of various combinations of substrates 74 (See FIGS. 1A, 1B, 2A, and 2B) that can be planarized employing the first or second exemplary apparatus (100, 200) of FIGS. 1A, 1B, 2A, and 2B are overlapped with a bottom view of the spindle assembly structure 40 in FIG. 3B. In one embodiment, a first set of four or five 200 mm substrates 74A can be planarized simultaneously employing the first or second exemplary apparatus (100, 200). In another embodiment, a second set of one or two 300 mm substrates 74B can be planarized simultaneously employing the first or second exemplary apparatus (100, 200). In yet another embodiment, a third set of a single 450 mm substrate 74C can be planarized simultaneously employing the first or second exemplary apparatus (100, 200).

In still another embodiment, the area of the spindle frame 30 can be expanded or reduced to accommodate a greater, or a lesser, number of substrates.

Figures 4A, 4B:
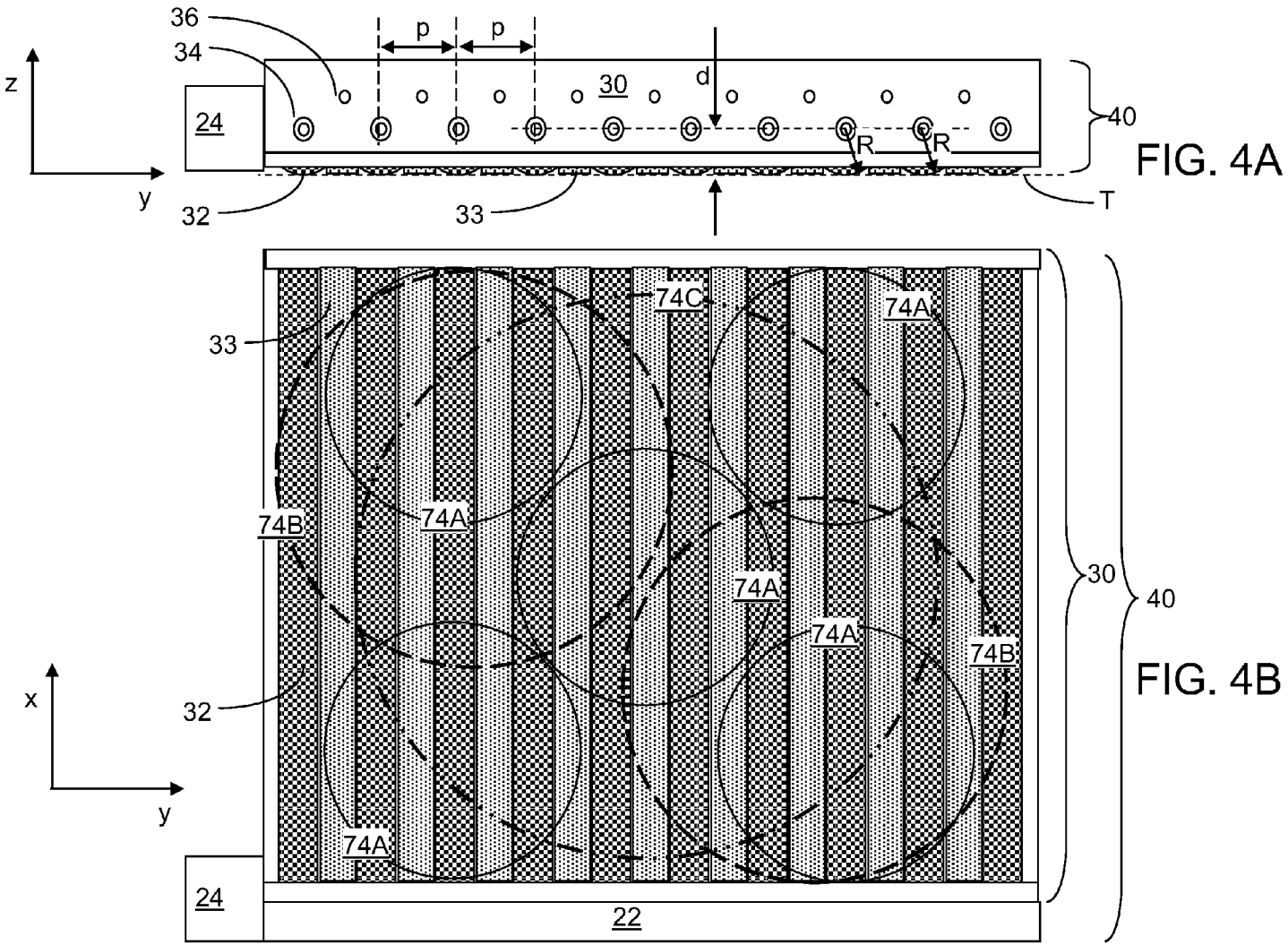
FIG. 4A is a side view of a second example for a spindle assembly structure according to an embodiment of the present disclosure.
FIG. 4B is a bottom view of the second example for the spindle assembly structure of FIG. 4A according to an embodiment of the present disclosure.

Referring to FIGS. 4A and 4B, a second example for the spindle assembly structure 40 is illustrated in detail. The second example for the spindle assembly structure 40 can be employed in the first or second exemplary apparatus (100, 200) of FIGS. 1A, 1B, 2A, and 2B.

The second example for the spindle assembly structure 40 can be derived from the first example for the spindle assembly structure 40 illustrated in FIGS. 3A and 3B by attaching at least one static polishing pad 33 to bottom portions of the spindle frame 30 in the spaces between neighboring pairs of cylindrical spindles 32. The spindle frame 30 in the first example for the spindle assembly structure 40 in FIGS. 3A and 3B can be modified to provide stationary support structures between each neighboring pair of cylindrical spindles 32 and between the two-dimensional plane T and a plane formed by connecting the axes 34 of rotation for the cylindrical spindles 32. The at least one static polishing pad 33 can be attached to the stationary support structures.

The at least one static polishing pad 33 remains stationary on the frame of the spindle assembly structure 40, i.e., on the spindle frame 30, during the relative movement between the spindle assembly structure 40 and the carrier platform 68. The at least one static polishing pad 33 has an abrasive surface. The abrasive surface of the at least one static polishing pad 33 can be provided by any abrasive material known in the art. The bottom surface(s) of the at least one static polishing pad 33 can be coplanar with, or substantially coplanar with, the two-dimensional plane T. As used herein, two surfaces are substantially coplanar with each other if the vertical offset between the two planes is less than 100 nm.

The at least one static polishing pad 33 functions as an additional abrasive surface, or "a secondary platen," that contacts the surface(s) of the at least one substrate 74 (See FIGS. 1A, 1B, 1C, and 1D) with a linear motion. The at least one static polishing pad thus increases the surface area in contact with the at least one substrate 74, thereby increasing throughput of the first and second exemplary apparatuses (100, 200) without employing any conventional rotational motion on the at least one substrate 74. In addition, the at least one static polishing pad 33 can have different abrasive characteristics (such as abrasion rate or the grit of the abrasive material on the surface) so that multiple types of polish pads of varying characteristics (soft and hard, for example) can be incorporated in a single polishing cycle through the use of the cylindrical abrasive pad on the cylindrical spindles and planar polishing pads for the at least one static polishing pad 33.

Figure 5:
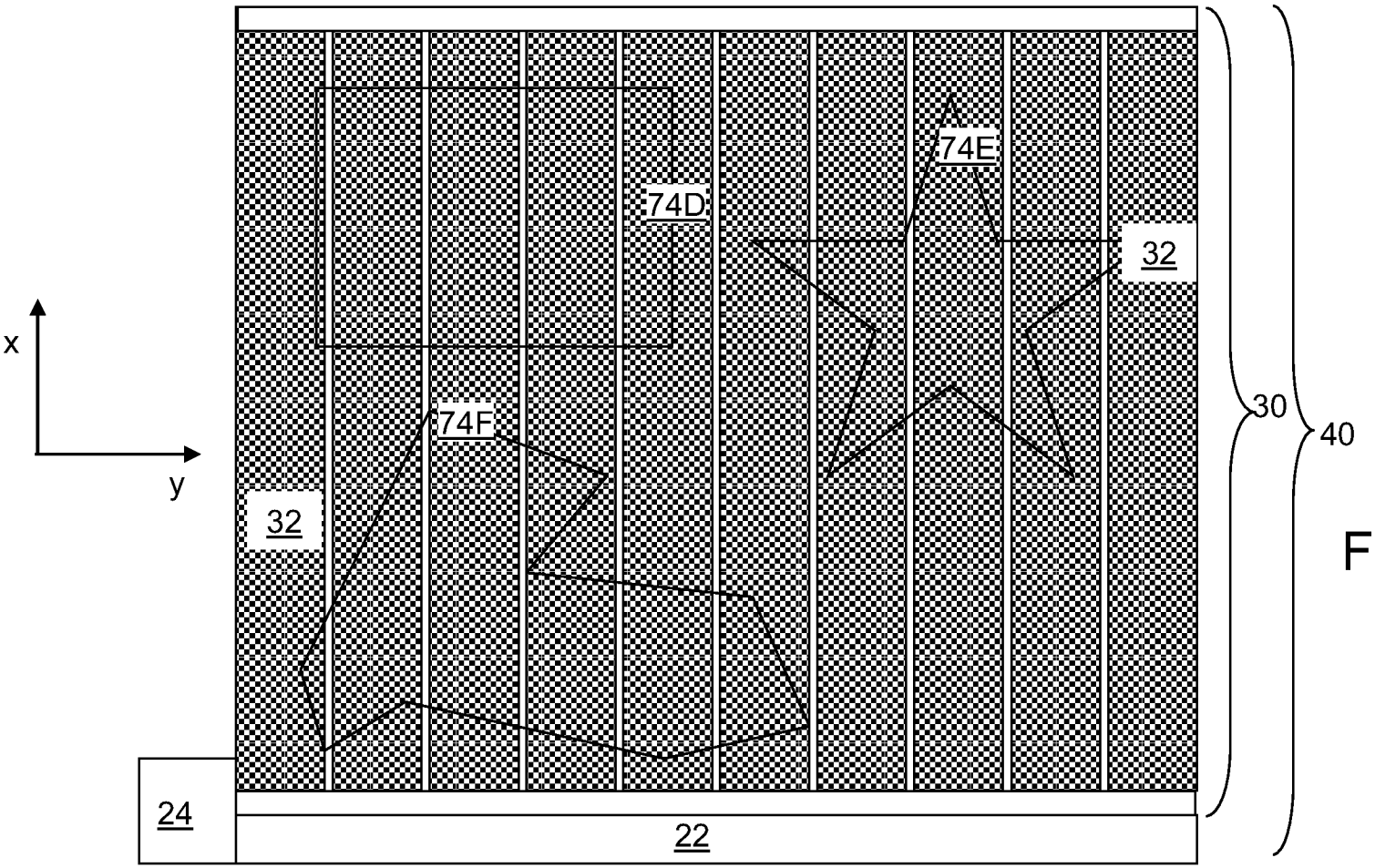
FIG. 5 is a bottom view of the first exemplary spindle assembly structure of FIG. 3A on which peripheries of exemplary arbitrary-shaped substrates are shown according to an embodiment of the present disclosure.

Referring to FIG. 5, a feature of the apparatuses (100, 200) of the present disclosure that allow planarization of substrates of various sizes and shapes is schematically illustrated. Specifically, peripheries of various substrates (74D, 74E, 74F) that can be planarized as a substrate 74 (See FIGS. 1A, 1B, 2A, and 2B) employing the first or second exemplary apparatus (100, 200) of FIGS. 1A, 1B, 2A, and 2B are overlapped with a bottom view of the spindle assembly structure 40, which can be the same as the first example illustrated in FIGS. 3A and 3B or the second example illustrated in FIGS. 4A and 4B.

Figure 6:
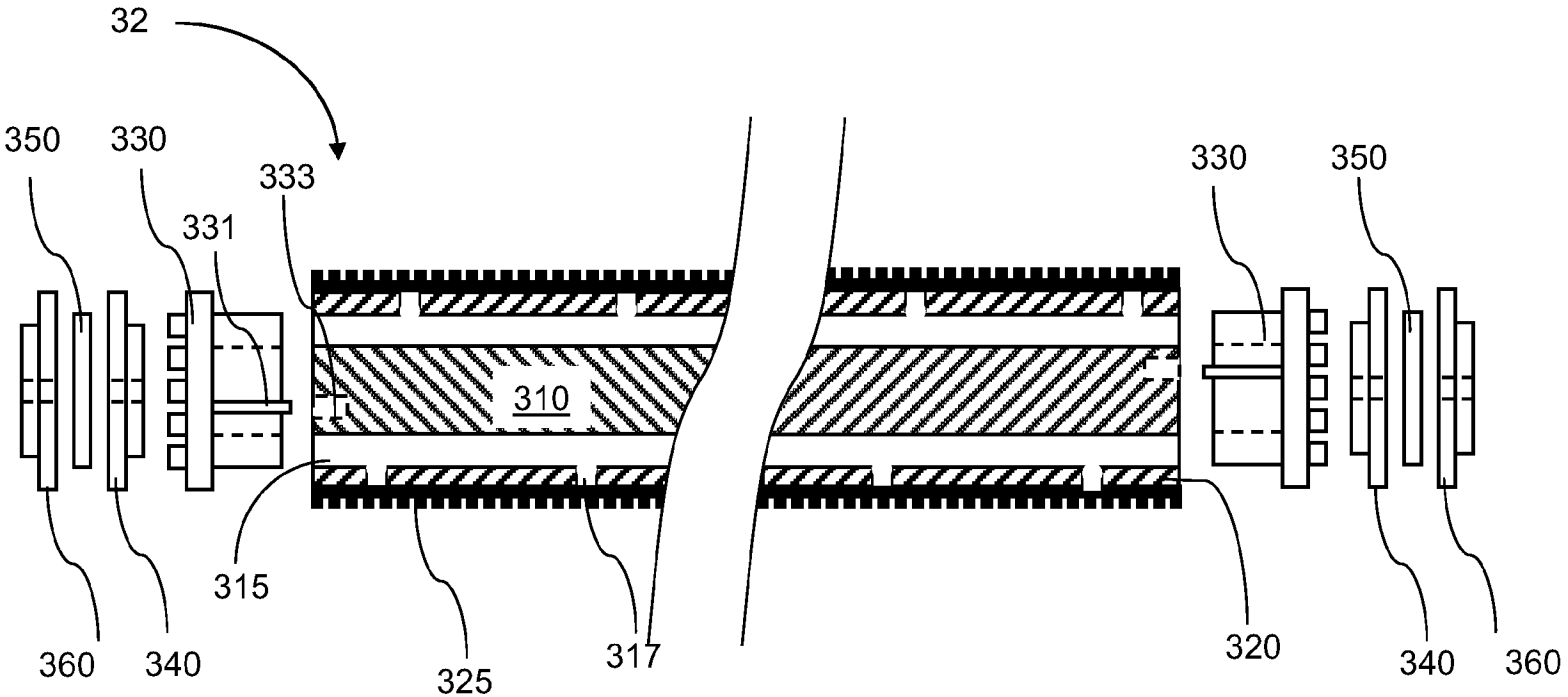
FIG. 6 is a cross-sectional view of a cylindrical spindle and accompanying coupling structures according to an embodiment of the present disclosure.

Referring to FIG. 6, a cylindrical spindle 32 and accompanying coupling structures according to an embodiment of the present disclosure are shown in a cross-sectional view that shows a plane that intersects the axis of rotation for the cylindrical spindle 32.

In one embodiment, the cylindrical spindle 32 can include a spindle frame structure (310, 320) that includes at least one of a spindle core structure 310 and a spindle shell structure 320. One or both of the spindle core structure 310 and the spindle shell structure 320 can be present in the spindle frame structure (310, 320) provided that the spindle frame structure maintains structural integrity during rotation against the surface(s) of the at least one substrate 74 (See FIGS. 1A, 1B, 2A, and 2B) during a planarization step. A cylindrical abrasive pad 325 can be attached to the outer surface of a spindle shell structure 320. Alternately, the cylindrical abrasive pad 325 can be attached to a spindle core structure 310 if no spindle shell structure is employed, and the spindle core structure 310 contiguously extends to the cylindrical abrasive pad 325. Thus, each of the cylindrical surfaces of the plurality of cylindrical spindles 32 in the first and second exemplary apparatus (100, 200) can be an abrasive surface of cylindrical abrasive pads 325.

In one embodiment, the spindle frame structure (310, 320) includes the spindle shell structure 320 without any perforation hole therein, and a cavity 315 can be provided between the spindle core structure 310 and the spindle shell structure 320. The cavity 315 can be spaced from the cylindrical abrasive pads 325 by the spindle shell structure 320 and a coolant can flow from one side of the cavity 315 to the other side of the cavity without leakage.

In another embodiment, the spindle frame (310, 320) includes the spindle shell structure 320 having a plurality of perforation holes 317 therein, and a cavity 315 can be provided between the spindle core structure 310 and the spindle shell structure 320. During the operation of the first or second exemplary apparatus (100, 200), a slurry can be allowed to flow into the cavity 315. The plurality of perforation holes 317 allows emission of the slurry therethrough and onto the at least one substrate 74. One side of the cavity 315 may be open to accept the entry of the slurry into the cavity 315, and the other side of the cavity 315 may be sealed.

The accompanying coupling structures can include, for example, tube assembly couplers 330 having a key 331 that fits into a key hole 333 located within the spindle frame structure (310, 320). Further, the accompanying coupling structures can include two magnetic disconnect assemblies, each of which include an inner magnetic coupling piece 340, a suspension piece 350 which may or may not include bearings (not shown), and an outer magnetic coupling piece 360 configured to rotate with a gear in the gear assembly 22 (See FIGS. 3A, 4A, and 7). It is noted that only one of the two outer magnetic coupling piece 360 needs to be rotated in order to impart a rotational motion to a cylindrical spindle 32.

Figure 7:
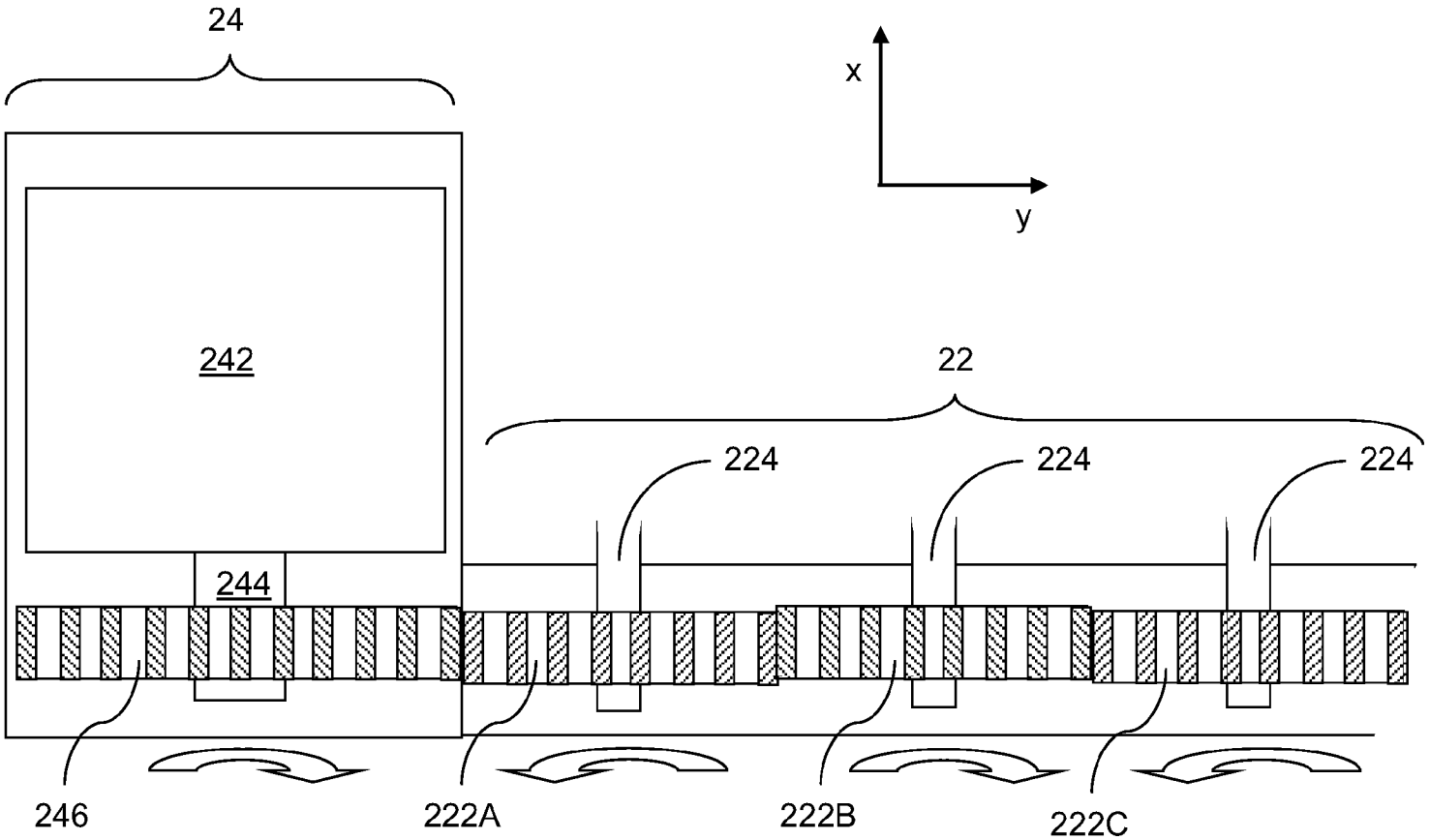
FIG. 7 is a top-down view of a gear driver motor and gears within a gear assembly according to an embodiment of the present disclosure.

Referring to FIG. 7, the gear driver motor 24 and some of the gears (222A, 222B, 222C) within the gear assembly 22 according to an embodiment of the present disclosure are shown in a top-down view, in which top covers for the gear drive motor 24 and the gear assembly 22 have been removed for clarity.

The gear driver motor 24 includes an electrical motor 242, and an axle 244 and a primary gear 246 that are connected to the electrical motor and rotates while the electrical motor 242 runs. Each of the gears (222A, 222B, 222C) is engaged to the primary gear 246 either directly or through other gears (222A, 222B). An axle 224 is attached to each of the gears (222A, 222B, 222C) on one end, and is structurally attached to an outer magnetic coupling piece 360 (not shown, see FIG. 6) such that the axis of the axle 224 and the axis of the outer magnetic coupling piece 360 coincide.

In an alternate embodiment, the axles 224 can be omitted, and the gears (222A, 222B, 222C) can be outer magnetic coupling piece 360. The rotational directions are illustrated by semicircular arrows. In another embodiment, all of the plurality of cylindrical spindles can be configured to rotate in a same rotational direction (e.g., clockwise or counterclockwise) by inserting additional gears (not shown) between each neighboring pairs of the gears (222A, 222B, 222C) illustrated herein.

Figure 8:
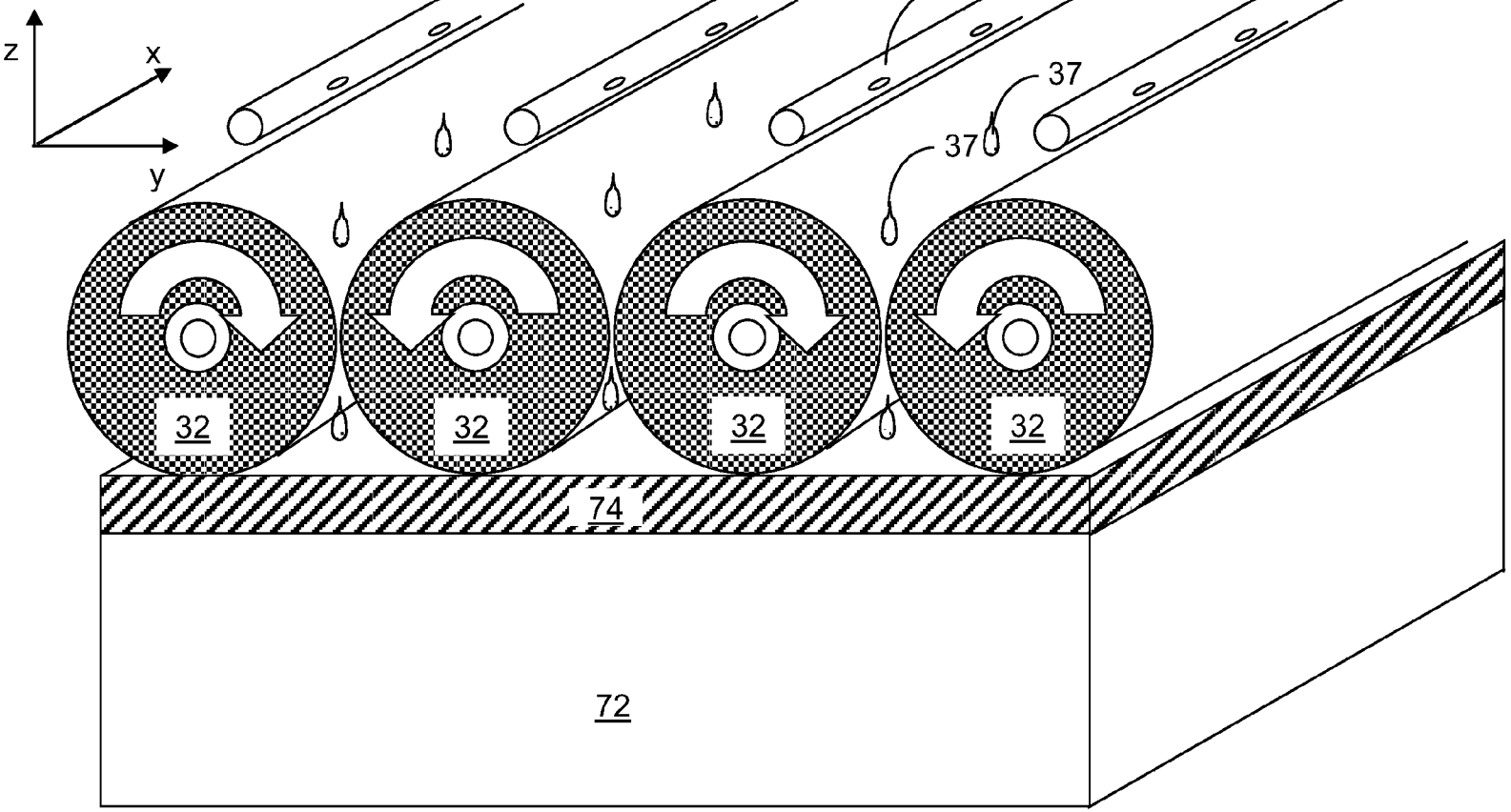
FIG. 8 is a side view for a set of cylindrical spindles, a substrate, a substrate carrier, and fluid distribution manifolds during operation of an apparatus for chemical mechanical planarization according to an embodiment of the present disclosure.

Referring to FIG. 8, a set of cylindrical spindles 32, a substrate 74, a substrate carrier 72, and fluid distribution manifolds 36 are illustrated in a cross-sectional view along a y-z plane during operation of the first or second exemplary apparatus (100, 200) according to an embodiment of the present disclosure. The fluid distribution manifold 36 is configured to drop slurry 37 through a gap between neighboring pairs of the cylindrical spindles 32 onto the at least one substrate 74 during operation of the first or second exemplary apparatus (100, 200). By dropping slurry droplets 37 directly on a surface that is planarized during a planarization process, the distance that the slurry needs to travel from an initial point at which a slurry droplet 37 contacts a surface under planarization to a point at which material removal occurs is less than the spacing between a neighboring pair of cylindrical spindles 32. Thus, the slurry distribution is efficient, and the slurry consumption is less compared to CMP apparatuses known in the art. Further, upon exiting the fluid distribution manifold 36, the slurry droplets 37 can arrive at the surface under planarization solely by gravity, thereby simplifying the control for slurry distribution.

The fluid distribution manifold 36 can supply slurry, water, cleaning solution, etchant, or any other fluid known in the art that can be employed prior to, during, or after polishing of the surface of the substrate 72. Thus, the first or second exemplary apparatus (100, 200) can be employed as a precleaner module that supplies a first fluid for treating the top surface of the substrate 72 prior to polishing, a polisher module that planarizes the top surface of the substrate with the rotation of the cylindrical spindles while a second fluid including at least a slurry is provided through the fluid distribution manifold 36, and/or a post-polishing treatment module that treats the top surface of the substrate 72 with a third fluid that is provided through the fluid distribution manifold 36. Individual pipes in the fluid distribution manifold 36 can be employed as common distribution paths for multiple types of fluids, or different pipes in the fluid distribution manifold 36 may be dedicated for distribution of different fluids. In some embodiments, multiple different fluid distribution manifolds 36, each configured to distribute a specific type of fluid, can be provided.

Figure 9:
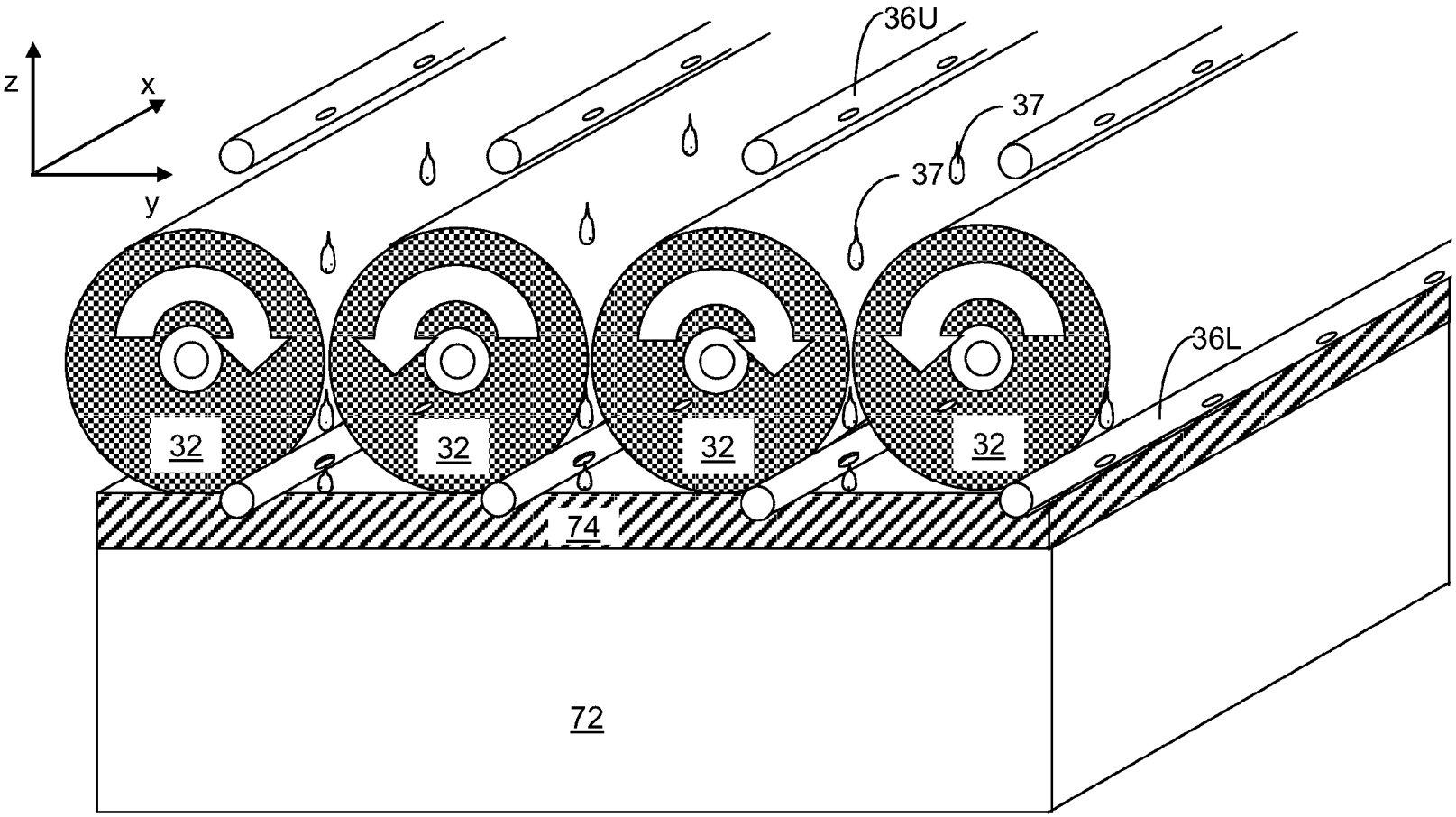
FIG. 9 is a side view for a set of cylindrical spindles, a substrate, a substrate carrier, and fluid distribution manifolds during operation of another apparatus for chemical mechanical planarization according to an embodiment of the present disclosure.

Referring to FIG. 9, the fluid distribution manifolds 36 in the apparatus illustrated in FIG. 8 can be modified to provide an upper fluid distribution manifold 36U and a lower fluid distribution manifold 36L.

Figure 10:
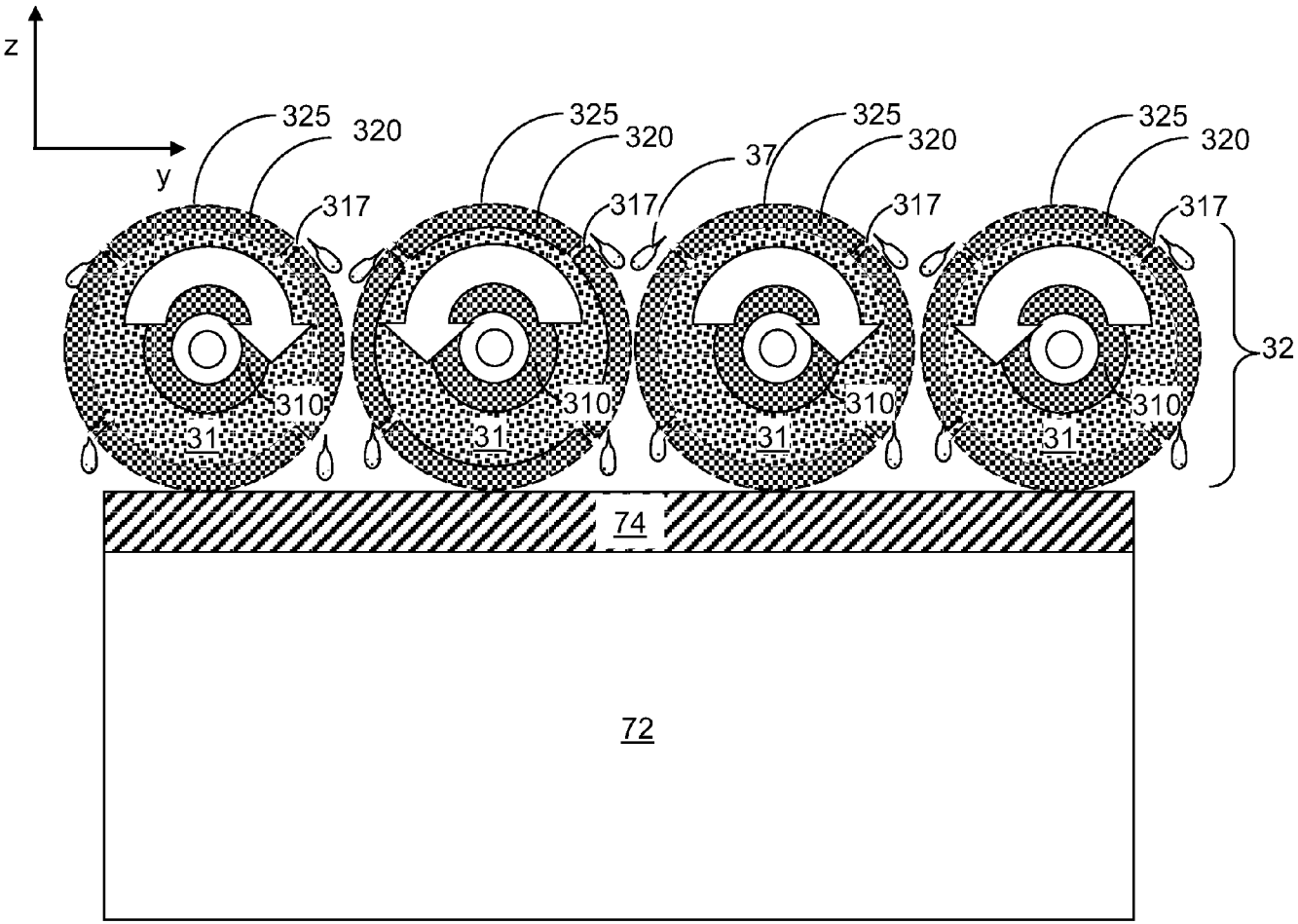
FIG. 10 is a vertical cross-sectional view for a set of cylindrical spindles, a substrate, a substrate carrier, and perforation holes for distribution of slurry from a cavity filled with a slurry onto the substrate during operation of an apparatus for chemical mechanical planarization according to an embodiment of the present disclosure.

Referring to FIG. 10, a set of cylindrical spindles 32, a substrate 74, a substrate carrier 72, and perforation holes 317 are illustrated in a vertical cross-sectional view. Each cylindrical spindle 32 includes an optional spindle core structure 310 (that can be removed) and a spindle shell structure 320. A cavity, which is the same as the cavity in FIG. 6, is provided within the spindle shell structure 320, and is filled with a slurry 31, or any other suitable fluid such as water, cleaning solution, etchant, or any other fluid known in the art that can be employed prior to, during, or after polishing of the surface of the substrate 72, that is supplied through a fluid distribution manifold 36 (See FIGS. 1B and 2B) and through an opening on one side of each cylindrical spindles 32. The spindle shell structure 320 includes a plurality of perforation holes 317 therein. The cylindrical abrasive pad 325 can be permeable or can have additional perforation holes to allow passage of the slurry 31 therethrough.

In one embodiment, elements of the various fluid distribution methods described for FIGS. 8, 9, and 10 may be combined. Further, the various embodiments can also be employed for "abrasive free" planarization methods in which no slurry is employed during the polishing. In such embodiment, the fluid distribution manifolds (36, 36U, 36L) can be employed to pre-treat, or post-treat, the surface of the substrate 72 prior to, or after, the planarization step.

During the operation of the first or second exemplary apparatus (100, 200), the slurry 31 flows into the cavity, and is emitted through the plurality of perforation holes 317 and the cylindrical abrasive pads 325. One side of the cavity 315 may be open to accept the entry of the slurry into the cavity 315, and the other side of the cavity 315 may be sealed. As in the slurry distribution system illustrated in FIG. 8, by dropping slurry droplets 37 directly on a surface that is planarized during a planarization process, the distance that the slurry needs to travel from an initial point at which a slurry droplet 37 contacts a surface under planarization to a point at which material removal occurs is less than the spacing between a neighboring pair of cylindrical spindles 32.

The apparatuses of the present disclosure can provide an efficient fresh slurry distribution to, and effluent retraction from, a substrate and various polish pad surfaces. Compression and relaxation of the polishing pad materials as they come into contact with a polished surface can be significantly reduced or eliminated employing the apparatuses of the present disclosure, thereby providing a uniform planarization process. Further, within-wafer non-uniformity associated with the rotational motion of a polish pad and/or a substrate can also be significantly reduced in some embodiments by eliminating rotation of the substrates during the planarization.

In one perspective, the apparatus of the present disclosure eliminates a bladder carrier as known in the art by eliminating rotation around any direction perpendicular to surfaces under planarization. Thus, the apparatus of the present disclosure allows the thickness profile and topography of a planarized substrate surface to be controlled to a much finer degree of precision than CMP apparatuses known in the art.

While the disclosure has been described in terms of specific embodiments, it is evident in view of the foregoing description that numerous alternatives, modifications and variations will be apparent to those skilled in the art. Accordingly, the disclosure is intended to encompass all such alternatives, modifications and variations which fall within the scope and spirit of the disclosure and the following claims.

What is claimed is:

1. An apparatus for chemical mechanical planarization comprising:

a spindle assembly structure including a plurality of cylindrical spindles and at least one static polishing pad, wherein each of said cylindrical spindles is configured to rotate around its axis of cylindrical symmetry, and a two-dimensional plane tangentially contacts cylindrical surfaces of said plurality of cylindrical spindles; and at least one substrate carrier that is configured to hold at least one substrate and mounted on a carrier platform, wherein said spindle assembly structure and said carrier platform are configured to move relative to each other along a direction that is parallel to said two-dimensional plane, wherein said at least one static polishing pad remains stationary on a frame of said spindle assembly structure during said relative movement between said spindle assembly structure and said carrier platform.

2. The apparatus of claim 1, wherein multiple cylindrical spindles in said plurality of cylindrical spindles have axes of cylindrical symmetry that are parallel to one another.

3. The apparatus of claim 2, wherein said axes of cylindrical symmetry are arranged in a one-dimensional array having a pitch.

4. The apparatus of claim 2, wherein said multiple cylindrical spindles in said plurality of cylindrical spindles have a same radius.

5. The apparatus of claim 2, wherein said axes of cylindrical symmetry are oriented along a first direction that is parallel to said two-dimensional plane, and said direction along which said spindle assembly structure and said carrier platform are configured to move relative to each other is a second direction is different from said first direction.

6. The apparatus of claim 1, wherein said at lest one static polishing pad has an abrasive surface that is substantially coplanar with said two-dimensional plane.

7. The apparatus of claim 1, wherein said two-dimensional plane is a horizontal plane, and said spindle assembly structure overlies said carrier platform.

8. The apparatus of claim 1, wherein said apparatus is configured to move said spindle assembly structure and said carrier platform relative to each other in a direction perpendicular to said two-dimensional plane.

9. The apparatus of claim 8, wherein said apparatus is configured to move said spindle assembly structure and said carrier platform relative to each other, when said at least one substrate is mounted on said at least one substrate carrier, until a contact is made between at least one top surface of said at least one substrate and portions of said cylindrical surfaces on said two-dimensional plane.

10. The apparatus of claim 9, wherein said spindle assembly structure and said carrier platform are configured to move relative to each other along said direction while said at least one substrate remains in contact with said portions of said cylindrical surfaces on said two-dimensional plane.

11. The apparatus of claim 1, wherein a center of mass of said spindle assembly structure remains stationary, and a center of mass of said carrier platform moves along said direction.

12. The apparatus of claim 1, wherein a center of mass of said carrier platform remains stationary, and a center of mass of said spindle assembly structure moves along said direction.

13. The apparatus of claim 1, wherein said spindle assembly structure and said carrier platform are configured to move relative to each other in a back-and-forth motion along said direction.

14. The apparatus of claim 1, wherein further comprising a fluid distribution manifold configured to drop slurry through a gap between neighboring pairs of said cylindrical spindles onto said at least one substrate during operation of said apparatus.

15. The apparatus of claim 1, wherein each of said at least one substrate carrier is configured to be stationary relative to said carrier platform.

16. The apparatus of claim 1, wherein each of said at least one substrate carrier is configured to rotate around an axis that is perpendicular to said two-dimensional plane.

17. The apparatus of claim 1, wherein each of said cylindrical surfaces is an abrasive surface of a cylindrical abrasive pad.

18. The apparatus of claim 1, wherein at least one of said plurality of cylindrical spindles has a cavity configured to allow passage of a coolant therethrough.

19. The apparatus of claim 1, wherein at least one of said plurality of cylindrical spindles has a cavity configured to allow entry of a slurry, and said cylindrical surfaces are perforated to allow emission of said slurry therethrough.

* * * * *